US012092111B2

(12) United States Patent
Bergman et al.

(10) Patent No.: US 12,092,111 B2
(45) Date of Patent: Sep. 17, 2024

(54) COMPRESSOR WITH OIL PUMP

(71) Applicant: Copeland LP, Sidney, OH (US)

(72) Inventors: Kyle M. Bergman, Yorkshire, OH (US); Frank Wallis, Sidney, OH (US)

(73) Assignee: Copeland LP, Sidney, OH (US)

( * ) Notice: Subject to any disclaimer, the term of this patent is extended or adjusted under 35 U.S.C. 154(b) by 76 days.

(21) Appl. No.: 17/854,908

(22) Filed: Jun. 30, 2022

(65) Prior Publication Data

US 2024/0003348 A1 Jan. 4, 2024

(51) Int. Cl.
*F04C 18/00* (2006.01)
*F04C 18/02* (2006.01)
(Continued)

(52) U.S. Cl.
CPC ..... *F04C 29/025* (2013.01); *F04C 18/0215* (2013.01); *F04C 29/0042* (2013.01); *F04C 29/023* (2013.01); *F04C 2240/50* (2013.01); *F04C 2240/603* (2013.01); *F04C 2240/809* (2013.01)

(58) Field of Classification Search
CPC ..... F04C 18/0215; F04C 23/008; F04C 29/0042; F04C 29/023; F04C 29/025; F04C 2240/50; F04C 2240/60; F04C 2240/603; F04C 2240/809
See application file for complete search history.

(56) References Cited

U.S. PATENT DOCUMENTS 2,777,394 A 1/1957 Modrovsky
3,039,677 A 6/1962 Nissley
(Continued)

FOREIGN PATENT DOCUMENTS

CN 2081885 U 7/1991
CN 1127541 A 7/1996
(Continued)

OTHER PUBLICATIONS

Office Action regarding Chinese Patent Application No. 201110089527.2, dated May 5, 2014. Translation provided by Unitalen Attorneys At Law.
(Continued)

*Primary Examiner* — Theresa Trieu
(74) *Attorney, Agent, or Firm* — Harness, Dickey & Pierce, P.L.C.

(57) ABSTRACT

A compressor may include a compression mechanism and an oil pump. The compression mechanism is configured to compress a working fluid. The oil pump may be defined by a driveshaft and a bearing. The driveshaft is drivingly connected to the compression mechanism and includes a lubricant passage. The bearing receives a portion of the driveshaft and includes a bearing surface that rotatably supports the driveshaft. The bearing includes a pump cavity surface that is spaced apart from the driveshaft and cooperates with a diametrical surface of the driveshaft to define a pump cavity that extends around the diametrical surface of the driveshaft. The bearing includes an inlet passage and an outlet passage. The inlet passage receives oil from an oil sump and provides oil to the pump cavity. The outlet passage receives oil from the pump cavity and provides oil to the lubricant passage of the driveshaft.

21 Claims, 5 Drawing Sheets

(51) Int. Cl.

| | |
|---|---|
| ***F04C 29/00*** | (2006.01) |
| ***F04C 29/02*** | (2006.01) |

(56) References Cited

U.S. PATENT DOCUMENTS

| | | | | |
|---|---|---|---|---|
| 3,229,901 | A | 1/1966 | Parker | |
| 3,334,808 | A | 8/1967 | Parker et al. | |
| 3,448,918 | A | 6/1969 | Cawley | |
| 3,465,954 | A | 9/1969 | Ellis | |
| 3,545,891 | A | 12/1970 | Parker | |
| 3,584,980 | A | 6/1971 | Cawley et al. | |
| 3,586,456 | A | 6/1971 | Giacosa | |
| 3,663,127 | A | 5/1972 | Cheers | |
| 4,065,279 | A | 12/1977 | McCullough | |
| 4,421,453 | A | 12/1983 | Hoff et al. | |
| 4,449,895 | A | 5/1984 | Kurahayashi | |
| 4,456,437 | A | 6/1984 | Kurahayashi et al. | |
| 4,462,772 | A | 7/1984 | Hazaki et al. | |
| 4,551,082 | A | 11/1985 | Hazaki et al. | |
| 4,564,339 | A | 1/1986 | Nakamura et al. | |
| 4,568,253 | A | 2/1986 | Wood | |
| 4,592,703 | A | 6/1986 | Inaba et al. | |
| 4,609,334 | A | 9/1986 | Muir et al. | |
| 4,639,194 | A | 1/1987 | Bell, III et al. | |
| 4,702,682 | A | 10/1987 | Inaba et al. | |
| 4,792,296 | A | 12/1988 | Kobayashi et al. | |
| 5,017,108 | A | 5/1991 | Murayama et al. | |
| 5,176,506 | A | 1/1993 | Siebel | |
| 5,221,191 | A | 6/1993 | Leyderman et al. | |
| 5,322,420 | A | 6/1994 | Yannascoli | |
| 5,368,446 | A | 11/1994 | Rode | |
| 5,385,453 | A | 1/1995 | Fogt et al. | |
| 5,391,066 | A | 2/1995 | Sawai et al. | |
| 5,445,507 | A | 8/1995 | Nakamura et al. | |
| 5,494,422 | A | 2/1996 | Ukai et al. | |
| 5,533,875 | A | 7/1996 | Crum et al. | |
| 5,553,465 | A | 9/1996 | Fukuda et al. | |
| 5,638,600 | A | 6/1997 | Rao et al. | |
| 5,707,220 | A | 1/1998 | Krueger et al. | |
| 5,810,572 | A | 9/1998 | Yamamoto et al. | |
| 5,810,573 | A * | 9/1998 | Mitsunaga | F04C 29/025 418/94 |
| 5,997,258 | A | 12/1999 | Sawyer, III et al. | |
| 6,039,551 | A | 3/2000 | Takeuchi et al. | |
| 6,196,814 | B1 | 3/2001 | Cooksey et al. | |
| 6,264,446 | B1 | 7/2001 | Rajendran et al. | |
| 6,746,216 | B2 | 6/2004 | Sun | |
| 7,317,041 | B2 | 1/2008 | Guffogg et al. | |
| 7,381,040 | B2 | 6/2008 | Ogasawara et al. | |
| 7,566,210 | B2 | 7/2009 | Elson et al. | |
| 7,789,616 | B2 | 9/2010 | Yen et al. | |
| 9,217,434 | B2 | 12/2015 | Han et al. | |
| 2004/0219048 | A1 | 11/2004 | Tsuchiya et al. | |
| 2005/0053508 | A1 | 3/2005 | Morozumi et al. | |
| 2005/0069443 | A1 | 3/2005 | Uekawa et al. | |
| 2007/0071627 | A1 | 3/2007 | Lee et al. | |
| 2007/0134118 | A1 * | 6/2007 | Yoo | F04C 29/025 418/94 |
| 2007/0183917 | A1 | 8/2007 | Um | |
| 2012/0263609 | A1 | 10/2012 | Han et al. | |
| 2014/0219850 | A1 | 8/2014 | Ignatiev et al. | |
| 2015/0044019 | A1 | 2/2015 | Wu et al. | |
| 2015/0361983 | A1 | 12/2015 | Ignatiev et al. | |
| 2016/0201673 | A1 | 7/2016 | Perevozchikov et al. | |
| 2016/0208803 | A1 | 7/2016 | Uekawa et al. | |
| 2016/0222967 | A1 | 8/2016 | Ignatiev et al. | |
| 2017/0002816 | A1 | 1/2017 | Uekawa | |
| 2018/0066656 | A1 | 3/2018 | Perevozchikov et al. | |
| 2018/0223850 | A1 | 8/2018 | Toyama | |
| 2019/0145414 | A1 | 5/2019 | Cui et al. | |
| 2020/0362863 | A1 | 11/2020 | Liang et al. | |

FOREIGN PATENT DOCUMENTS

| | | | |
|---|---|---|---|
| CN | 101303018 | A | 11/2008 |
| CN | 202152734 | U | 2/2012 |
| CN | 202300924 | U | 7/2012 |
| CN | 102734170 | A | 10/2012 |
| CN | 103790830 | B | 5/2016 |
| CN | 205578273 | U | 9/2016 |
| CN | 107559203 | A | 1/2018 |
| CN | 206889250 | U | 1/2018 |
| EP | 2700818 | A1 | 2/2014 |
| JP | S58214692 | A | 12/1983 |
| JP | S6220689 | A | 1/1987 |
| JP | H01257787 | A | 10/1989 |
| JP | H0427788 | A | 1/1992 |
| JP | H05-302580 | A | 11/1993 |
| JP | H09177688 | A | 7/1997 |
| JP | H11280668 | A | 10/1999 |
| JP | 2006-177239 | A | 7/2006 |
| JP | 2009127614 | A | 6/2009 |
| JP | 2012002227 | A | 1/2012 |
| JP | 2016160774 | A | 9/2016 |
| JP | 2019-138234 | A | 8/2019 |
| WO | WO-2013007163 | A1 | 1/2013 |
| WO | WO-2017/190651 | A1 | 11/2017 |
| WO | WO-2020061998 | A1 | 4/2020 |

OTHER PUBLICATIONS

Office Action regarding Chinese Patent Application No. 201110089527.2, dated Sep. 24, 2014. Translation provided by Unitalen Attorneys At Law.

Search Report regarding European Patent Application No. 12765121.4, dated Dec. 11, 2014.

Restriction Requirement regarding U.S. Appl. No. 14/355,793, dated Mar. 31, 2017.

Office Action regarding U.S. Appl. No. 14/355,793, dated Sep. 7, 2017.

Office Action regarding U.S. Appl. No. 14/355,793, dated Mar. 19, 2018.

Office Action regarding Indian Patent Application No. 1785/MUMNP/2013, dated May 23, 2018.

Advisory Action regarding U.S. Appl. No. 14/355,793, dated Jun. 12, 2018.

Office Action regarding U.S. Appl. No. 14/355,793, dated Aug. 9, 2018.

International Search Report regarding International Application No. PCT/US2012/031621, dated Oct. 12, 2012.

Written Opinion of the International Searching Authority regarding International Application No. PCT/US2012/031621, dated Oct. 12, 2012.

Applicant-Initiated Interview Summary regarding U.S. Appl. No. 14/355,793, dated Jan. 14, 2019.

Office Action regarding U.S. Appl. No. 14/355,793, dated May 16, 2019.

International Search Report regarding International Application No. PCT/CN2018/108228, dated Jun. 21, 2019.

Written Opinion of the International Searching Authority regarding International Application No. PCT/CN2018/108228, dated Jun. 21, 2019.

Applicant-Initiated Interview Summary regarding U.S. Appl. No. 14/355,793, dated Aug. 6, 2019.

Office Action regarding U.S. Appl. No. 14/355,793, dated Nov. 29, 2019.

Advisory Action regarding U.S. Appl. No. 14/355,793, dated Feb. 20, 2020.

International Search Report and Written Opinion of the ISA regarding Application No. PCT/US2020/024904 dated Jul. 15, 2020.

International Search Report and Written Opinion of the International Searching Authority issued in PCT/CN2018/108228, mailed Jun. 21, 2019.

Notice of Allowance regarding U.S. Appl. No. 16/829,303 dated Aug. 16, 2021.

(56) References Cited

OTHER PUBLICATIONS

Office Action regarding European Patent Application No. 189348709, dated Apr. 26, 2022.
Non-Final Office Action regarding U.S. Appl. No. 17/279,047 dated Aug. 1, 2022.
Office Action regarding Chinese Patent Application No. 201880099134X, dated Jul. 19, 2022.
Translation Office Action regarding Chinese Patent Application No. 201880099134X, dated Jul. 19, 2022.
Studies of Oil Flow Analysis in Hermetic 2013, Aphale et al.
Analysis of Oil Pumping in the Hermetic 2010, Wu et al.
International Search Report and Written Opinion of the ISA issued in PCT/US2023/025295, mailed Oct. 6, 2023; ISA/KR.

* cited by examiner

COMPRESSOR WITH OIL PUMP

FIELD

The present disclosure relates to a compressor with an oil pump.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., a refrigerant) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure and is not a comprehensive disclosure of its full scope or all of its features.

The present disclosure provides a compressor that may include a shell assembly, a compression mechanism, a driveshaft, and a bearing. The compression mechanism may be disposed within the shell assembly and is configured to compress a working fluid. The driveshaft is drivingly connected to the compression mechanism and includes a lubricant passage. The bearing is fixed relative to the shell assembly and may include a central aperture that receives a portion of the driveshaft. The central aperture of the bearing includes a bearing surface and a pump cavity surface. The bearing surface contacts and rotatably supports the driveshaft. The pump cavity surface is spaced apart from the driveshaft and cooperates with a diametrical surface of the driveshaft to define a pump cavity that extends around the diametrical surface of the driveshaft. The bearing includes an inlet passage and an outlet passage. The inlet passage receives oil from an oil sump and provides oil to the pump cavity. The outlet passage receives oil from the pump cavity and provides oil to the lubricant passage of the driveshaft.

In some configurations of the compressor of the above paragraph, the pump cavity surface has a larger diameter than the bearing surface.

In some configurations of the compressor of the above paragraph, the bearing includes an annular ledge that defines a transition between the pump cavity surface and the bearing surface.

In some configurations of the compressor of the above paragraph, the annular ledge defines an axial end of the pump cavity.

In some configurations, the compressor of any one or more of the above paragraphs includes a porting plate mounted to the bearing and including an inlet aperture, an outlet aperture, and a driveshaft inlet aperture.

In some configurations of the compressor of any one or more of the above paragraphs, the porting plate defines an axial end of the pump cavity.

In some configurations of the compressor of any one or more of the above paragraphs, the inlet aperture of the porting plate is in fluid communication with the inlet passage of the bearing and provides oil to the inlet passage.

In some configurations of the compressor of any one or more of the above paragraphs, the outlet aperture of the porting plate is in fluid communication with the outlet passage of the bearing and receives oil from the outlet passage.

In some configurations of the compressor of any one or more of the above paragraphs, the driveshaft inlet aperture is in fluid communication with the lubricant passage of the driveshaft.

In some configurations of the compressor of any one or more of the above paragraphs, the driveshaft inlet aperture receives oil from the outlet aperture and provides oil to the lubricant passage of the driveshaft.

In some configurations of the compressor of any one or more of the above paragraphs, an axial end of the driveshaft contacts the porting plate.

In some configurations, the compressor of any one or more of the above paragraphs includes a cover plate mounted to the bearing.

In some configurations of the compressor of any one or more of the above paragraphs, the porting plate is sandwiched between the cover plate and an axially facing surface of the bearing.

In some configurations of the compressor of any one or more of the above paragraphs, the cover plate includes an inlet aperture and a channel.

In some configurations of the compressor of any one or more of the above paragraphs, the inlet aperture of the cover plate receives oil from the oil sump and provides oil to the inlet aperture of the porting plate.

In some configurations of the compressor of any one or more of the above paragraphs, the channel receives oil from the outlet aperture of the porting plate and provides oil to the driveshaft inlet aperture of the porting plate.

In some configurations, the compressor of any one or more of the above paragraphs includes a pressure-regulation valve attached to the bearing.

In some configurations of the compressor of any one or more of the above paragraphs, the bearing includes a pressure-regulation port that extends from the pump cavity through an exterior surface of the bearing.

In some configurations of the compressor of any one or more of the above paragraphs, the pressure-regulation valve selectively restricts fluid flow through the pressure-regulation port.

In some configurations of the compressor of any one or more of the above paragraphs, the pump cavity extends more than 180 degrees and less than 360 degrees around the driveshaft.

In some configurations of the compressor of any one or more of the above paragraphs, the shell assembly defines the oil sump.

In some configurations of the compressor of any one or more of the above paragraphs, the lubricant passage of the driveshaft is a concentric lubricant passage.

In some configurations of the compressor of any one or more of the above paragraphs, the driveshaft includes an eccentric lubricant passage in fluid communication with the concentric lubricant passage. In other configurations, the driveshaft does not include an eccentric lubricant passage. In some of such configurations, the concentric lubricant passage may extend through the entire length of the driveshaft.

The present disclosure also provides a compressor that includes a compression mechanism and an oil pump. The compression mechanism is configured to compress a working fluid. The oil pump may be defined by a driveshaft and a bearing. The driveshaft is drivingly connected to the compression mechanism and includes a lubricant passage. The bearing receives a portion of the driveshaft and includes a bearing surface that rotatably supports the driveshaft. The bearing includes a pump cavity surface that is spaced apart from the driveshaft and cooperates with a diametrical surface of the driveshaft to define a pump cavity that extends around the diametrical surface of the driveshaft. The bearing includes an inlet passage and an outlet passage. The inlet passage receives oil from an oil sump and provides oil to the pump cavity. The outlet passage receives oil from the pump cavity and provides oil to the lubricant passage of the driveshaft.

In some configurations of the compressor of the above paragraph, the pump cavity surface has a larger diameter than the bearing surface.

In some configurations of the compressor of the above paragraph, the bearing includes an annular ledge that defines a transition between the pump cavity surface and the bearing surface.

In some configurations of the compressor of the above paragraph, the annular ledge defines an axial end of the pump cavity.

In some configurations, the compressor of any one or more of the above paragraphs includes a porting plate mounted to the bearing and including an inlet aperture, an outlet aperture, and a driveshaft inlet aperture.

In some configurations of the compressor of any one or more of the above paragraphs, the porting plate defines an axial end of the pump cavity.

In some configurations of the compressor of any one or more of the above paragraphs, the inlet aperture of the porting plate is in fluid communication with the inlet passage of the bearing and provides oil to the inlet passage.

In some configurations of the compressor of any one or more of the above paragraphs, the outlet aperture of the porting plate is in fluid communication with the outlet passage of the bearing and receives oil from the outlet passage.

In some configurations of the compressor of any one or more of the above paragraphs, the driveshaft inlet aperture is in fluid communication with the lubricant passage of the driveshaft.

In some configurations of the compressor of any one or more of the above paragraphs, the driveshaft inlet aperture receives oil from the outlet aperture and provides oil to the lubricant passage of the driveshaft.

In some configurations of the compressor of any one or more of the above paragraphs, an axial end of the driveshaft contacts the porting plate.

In some configurations, the compressor of any one or more of the above paragraphs includes a cover plate mounted to the bearing.

In some configurations of the compressor of any one or more of the above paragraphs, the porting plate is sandwiched between the cover plate and an axially facing surface of the bearing.

In some configurations of the compressor of any one or more of the above paragraphs, the cover plate includes an inlet aperture and a channel.

In some configurations of the compressor of any one or more of the above paragraphs, the inlet aperture of the cover plate receives oil from the oil sump and provides oil to the inlet aperture of the porting plate.

In some configurations of the compressor of any one or more of the above paragraphs, the channel receives oil from the outlet aperture of the porting plate and provides oil to the driveshaft inlet aperture of the porting plate.

In some configurations, the compressor of any one or more of the above paragraphs includes a pressure-regulation valve attached to the bearing.

In some configurations of the compressor of any one or more of the above paragraphs, the bearing includes a pressure-regulation port that extends from the pump cavity through an exterior surface of the bearing.

In some configurations of the compressor of any one or more of the above paragraphs, the pressure-regulation valve selectively restricts fluid flow through the pressure-regulation port.

In some configurations of the compressor of any one or more of the above paragraphs, the pump cavity extends more than 180 degrees and less than 360 degrees around the driveshaft.

In some configurations of the compressor of any one or more of the above paragraphs, a shell assembly defines the oil sump.

In some configurations of the compressor of any one or more of the above paragraphs, the lubricant passage of the driveshaft is a concentric lubricant passage.

In some configurations of the compressor of any one or more of the above paragraphs, the driveshaft includes an eccentric lubricant passage in fluid communication with the concentric lubricant passage. In other configurations, the driveshaft does not include an eccentric lubricant passage. In some of such configurations, the concentric lubricant passage may extend through the entire length of the driveshaft.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments, and not all possible implementations, and are not intended to limit the scope of the present disclosure.

Corresponding reference numerals indicate corresponding parts throughout the several views of the drawings.

DETAILED DESCRIPTION

Figure 1:
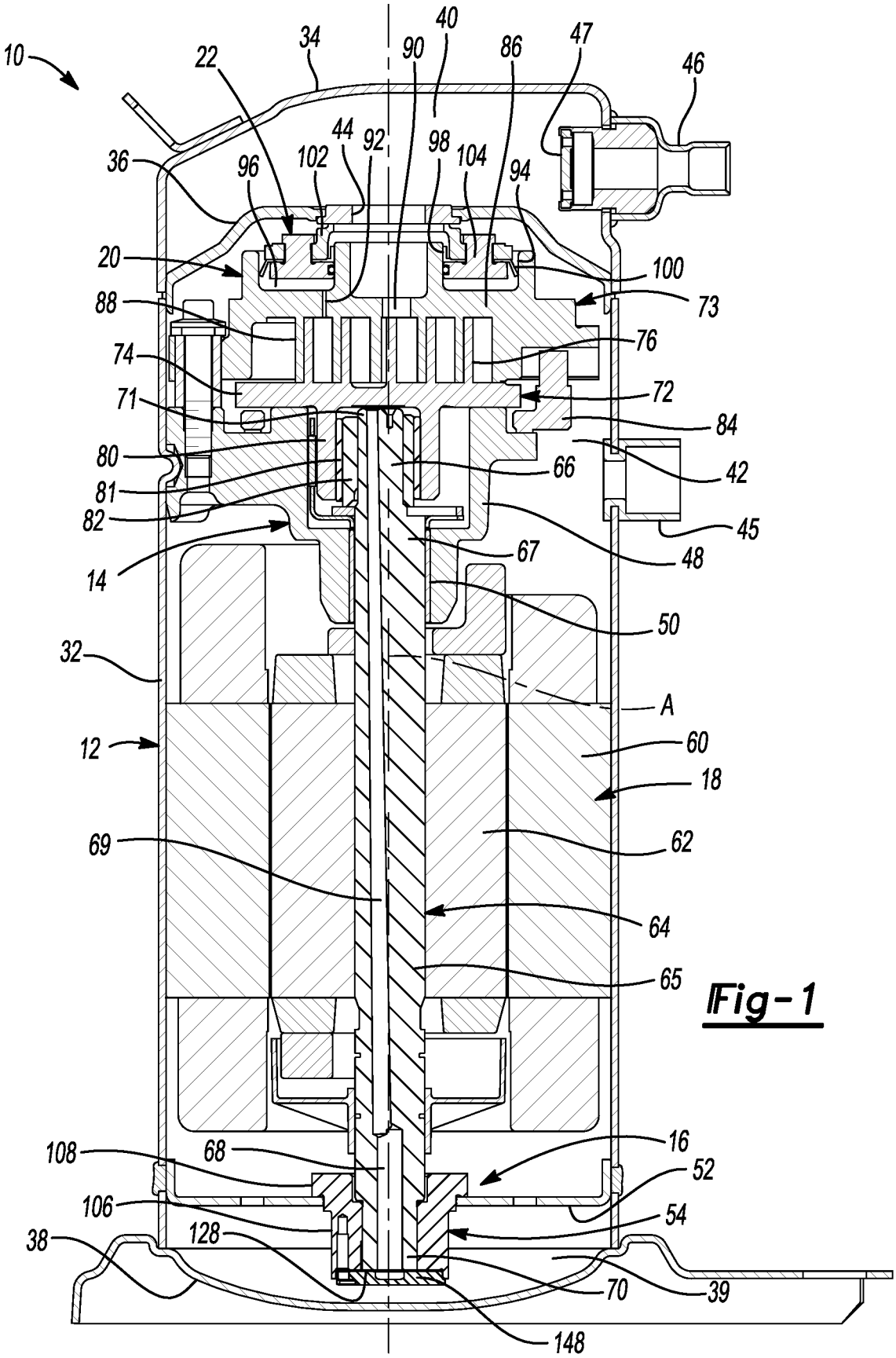
FIG. 1 is a cross-sectional view of a compressor having an oil pump according to the principles of the present disclosure.
Figures 2, 3:
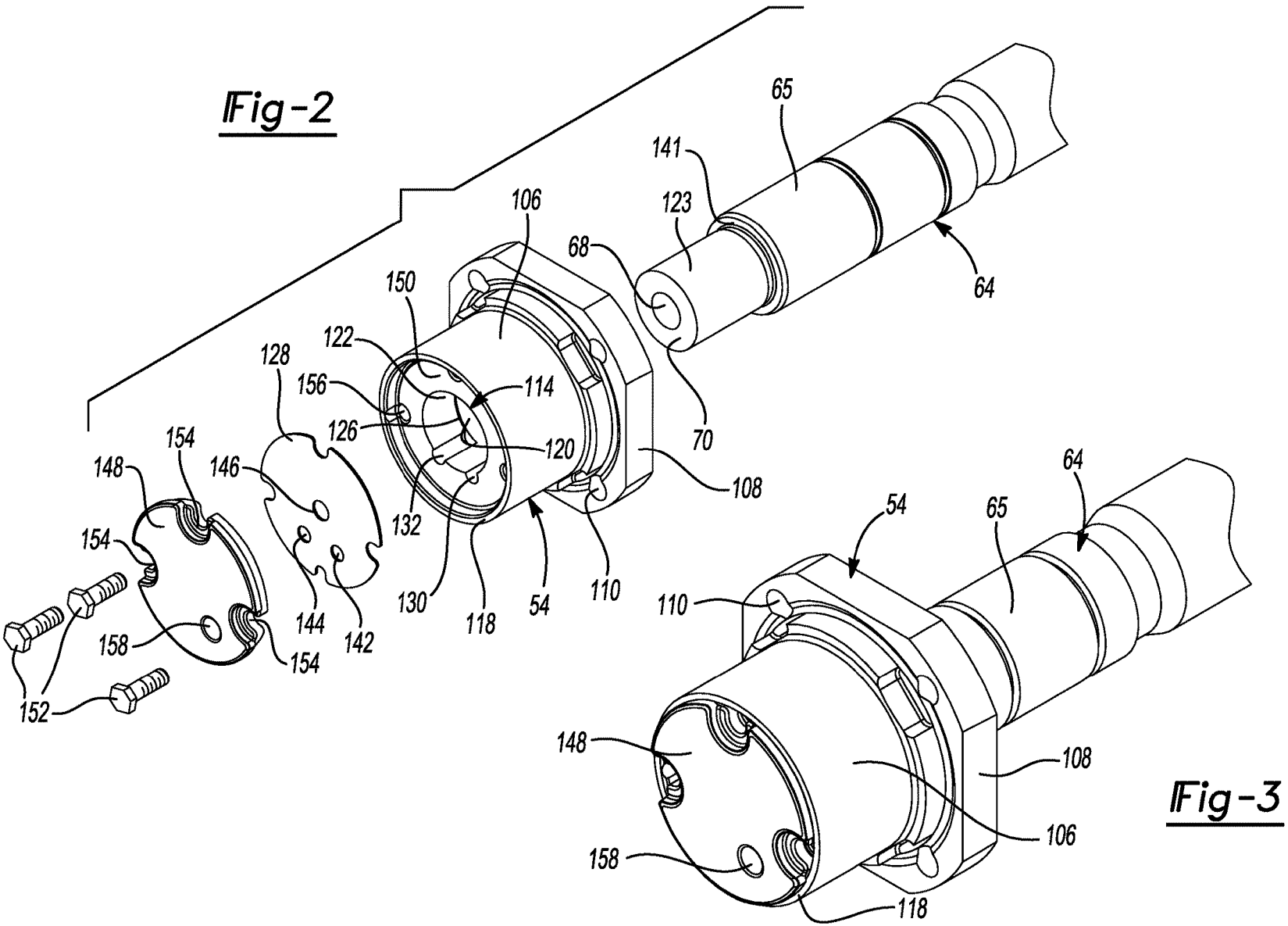
FIG. 2 is an exploded view of the oil pump.
FIG. 3 is a perspective view of the oil pump.
Figure 4:
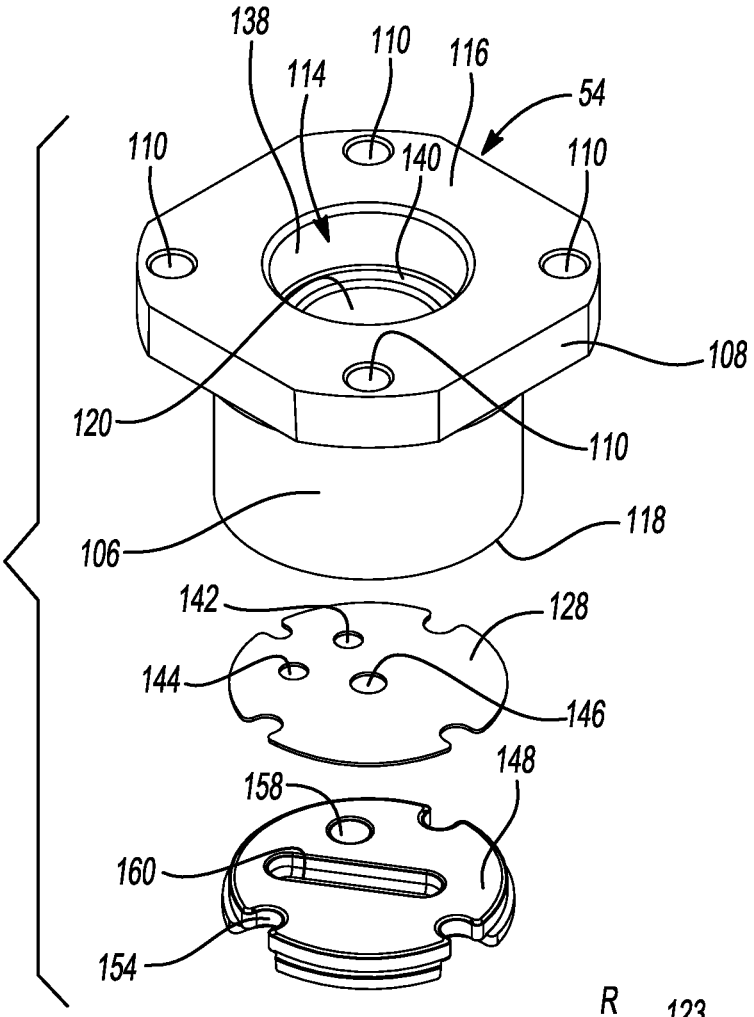
FIG. 4 is an exploded view of a bearing, a porting plate, and a cover plate.

Example embodiments will now be described more fully with reference to the accompanying drawings.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 10 is provided that may include a hermetic shell assembly 12, a first bearing-housing assembly 14, a second bearing-housing assembly 16, a motor assembly 18, a compression mechanism 20, and a seal assembly 22. The second bearing-housing assembly 16 may cooperate with a driveshaft 64 to define or function as an oil pump that draws oil from an oil sump 39 of the compressor 10 and pumps the oil in a manner that is energy-efficient and provides adequate oil flow at various compressor speeds.

The shell assembly 12 may form a compressor housing and may include a cylindrical shell 32, an end cap 34 at an upper end thereof, a transversely extending partition 36, and a base 38 at a lower end thereof. The end cap 34 and the partition 36 may define a discharge chamber 40. The partition 36 may separate the discharge chamber 40 from a suction chamber 42 that is at least partially defined by the shell 32. A discharge passage 44 may extend through the partition 36 to provide communication between the compression mechanism 20 and the discharge chamber 40. A suction fitting 45 may provide fluid communication between the suction chamber 42 and a low side of a system in which the compressor 10 is installed. A discharge fitting 46 may provide fluid communication between the discharge chamber 40 and a high side of the system in which the compressor 10 is installed. In some configurations, the compressor 10 may include a discharge valve assembly 47 that may be disposed within the discharge fitting 46, for example.

The shell assembly 12 may define the oil sump 39. For example, the oil sump 39 may be defined by the base 38. In some configurations, the oil sump 39 may be defined by the base 38 and the shell 32.

The first bearing-housing assembly 14 may be fixed relative to the shell 32 and may include a first bearing-housing 48 and a first bearing 50. The first bearing-housing 48 may axially support the compression mechanism 20 and may house the first bearing 50 therein. The first bearing-housing 48 may include a plurality of radially extending arms engaging the shell 32.

The second bearing-housing assembly 16 may be fixed relative to the shell 32 and may include a second bearing-housing 52 and a second bearing 54. The second bearing-housing 52 may support the second bearing 54 therein. The second bearing 54 may extend into the oil sump 39. The second bearing 54 will be described in more detail below.

The motor assembly 18 may include a stator 60, a rotor 62, and the driveshaft 64. The motor assembly 18 may be a variable-speed motor, a multiple-speed motor, or a fixed speed motor, for example. The stator 60 may be press fit into the shell 32. The rotor 62 may be press fit on the driveshaft 64 and may transmit rotational power to the driveshaft 64. The driveshaft 64 may be rotatably supported by the first and second bearing-housing assemblies 14, 16. The driveshaft 64 may include a main body 65 and an eccentric crank pin 66 extending from the main body 65. The main body 65 of the driveshaft 64 may be rotatably supported by the first and second bearings 50, 54. The crank pin 66 extends from a first axial end 67 of the main body 65 and may include a flat surface thereon.

The driveshaft 64 may include a concentric lubricant passage 68 and an eccentric lubricant passage 69. The concentric lubricant passage 68 may extend through a second axial end 70 of the main body 65 (e.g., a lower axial end of the driveshaft 64). The eccentric lubricant passage 69 is in fluid communication with the concentric lubricant passage 68. The eccentric lubricant passage 69 may extend upward from the concentric lubricant passage 68 and through a distal axial end 71 of the crank pin 66 (i.e., an upper axial end of the driveshaft 64). In some configurations, the driveshaft 64 includes one or more radially extending lubricant passages (not shown) that extend radially outward from either of the concentric or eccentric lubricant passages 68, 69 to provide lubricant to the first bearing 50, the second bearing 54, and/or any other components that require lubrication (e.g., a drive bearing 81 and drive bushing 82). As will be described in more detail below, rotation of the driveshaft 64 causes oil from the oil sump 39 to be drawn into and through the concentric and eccentric lubricant passages 68, 69. The driveshaft 64 is drivingly connected to the compression mechanism 20 such that rotation of the driveshaft 64 drives operation of the compression mechanism 20. In some configurations, the driveshaft 64 does not include an eccentric lubricant passage. Instead, the concentric lubricant passage 68 may extend through the entire length of the driveshaft 64 (e.g., through the main body 65 and the crank pin 66).

The compression mechanism 20 may be a scroll compression mechanism including first and second scrolls, for example. The first and second scrolls can be first and second co-rotating scrolls or the first and second scrolls could be orbiting and non-orbiting scrolls. In other examples, the compression mechanism 20 may be another type of compression mechanism, such as a reciprocating compression mechanism (e.g., including one or more pistons reciprocating within one or more cylinders), a rotary-vane compression mechanism (e.g., including a rotor rotating within a cylinder), or a screw compression mechanism (e.g., with a pair of intermeshed screws), for example. Any of these types of compression mechanisms are configured to compress a working fluid (e.g., a refrigerant) from a first pressure (e.g., a suction pressure) to a second pressure (e.g., a discharge pressure) that is higher than the first pressure.

In the example shown in FIG. 1, the compression mechanism 20 includes an orbiting scroll 72 and a non-orbiting scroll 73. The orbiting scroll 72 may include an end plate 74 and a spiral wrap 76 extending therefrom. A cylindrical hub 80 may project downwardly from the end plate 74 and may include the drive bushing 82 disposed therein. The drive bearing 81 may also be disposed within the hub 80 and may surround the drive bushing 82 and the crank pin 66 (i.e., the drive bearing 81 may be disposed radially between the hub 80 and the drive bushing 82). The drive bushing 82 may include an inner bore in which the crank pin 66 is drivingly disposed. The crank pin flat may drivingly engage a flat surface in a portion of the inner bore to provide a radially compliant driving arrangement. An Oldham coupling 84 may be engaged with the orbiting and non-orbiting scrolls 72, 73 to prevent relative rotation therebetween.

The non-orbiting scroll 73 may include an end plate 86 and a spiral wrap 88 projecting downwardly from the end plate 86. The spiral wrap 88 may meshingly engage the spiral wrap 76 of the orbiting scroll 72, thereby creating a series of moving fluid pockets containing working fluid. The fluid pockets defined by the spiral wraps 76, 88 may decrease in volume as they move from a radially outer position (at a suction pressure) to radially intermediate positions (at intermediate pressures between suction pressure and discharge pressure) to a radially inner position (at a discharge pressure that is greater than the suction and intermediate pressures) throughout a compression cycle of the compression mechanism 20.

The end plate 86 may include a discharge passage 90, an intermediate passage 92, and an annular recess 94. The discharge passage 90 is in communication with one of the fluid pockets at the radially inner position and allows compressed working fluid (e.g., at the discharge pressure) to flow into the discharge chamber 40. The intermediate passage 92 may provide fluid communication between one of the fluid pockets at the radially intermediate position and the annular recess 94. The annular recess 94 may receive the seal assembly 22 and cooperate with the seal assembly 22 to define an axial biasing chamber 96 therebetween. The biasing chamber 96 receives fluid from the fluid pocket in the intermediate position through the intermediate passage 92. A pressure differential between the intermediate-pressure fluid in the biasing chamber 96 and fluid in the suction chamber 42 exerts an axial biasing force on the non-orbiting scroll 73 urging the non-orbiting scroll 73 toward the orbiting scroll 72 to sealingly engage the scrolls 72, 73 with each other.

The seal assembly 22 may be a floating seal assembly. For example, the seal assembly 22 may be formed from one or more annular flexible seals 98, 100 and one or more annular rigid seal plates 102, 104. The seal assembly 22 may be received in the recess 94. The seal assembly 22 may sealingly engage the end plate 86 of the non-orbiting scroll 73, and during operation of the compressor 10, the seal assembly 22 may contact and sealingly engage the partition 36 to seal the discharge chamber 40 from the suction chamber 42.

Referring now to FIGS. 2-9, the second bearing 54 will be described in detail. The second bearing 54 may be a pump housing for the oil pump. The second bearing 54 may include a main body 106 and a flange portion 108. The flange portion 108 may extend radially outward from the main body 106. Fasteners may extend through apertures 110 in the flange portion 108 and engage the second bearing-housing 52 to fix the second bearing 54 relative to the second bearing-housing 52 and the shell assembly 12.

The second bearing 54 may include a central aperture 114 extending axially through first and second axial ends 116, 118 of the second bearing 54. A bearing surface 120 (FIGS. 7-9) may define an axially intermediate portion of the central aperture 114. The bearing surface 120 may rotatably support the driveshaft 64 (e.g., proximate the second axial end 70 of the main body 65 of the driveshaft 64). That is, the bearing surface 120 may contact a diametrical surface 123 of the driveshaft 64 proximate the second axial end 70 of the driveshaft 64.

A pump cavity surface 122 (FIGS. 7-9) may define an axially lower portion of the central aperture 114. The pump cavity surface 122 may be disposed axially between the bearing surface 120 and the second axial end 118 of the second bearing 54. The pump cavity surface 122 has a larger diameter than the bearing surface 120 such that the pump cavity surface 122 and the diametrical surface 123 of the driveshaft 64 cooperate to define an annular pump cavity (or recess) 124 (FIGS. 5 and 7-9). That is, the pump cavity 124 is defined radially between the pump cavity surface 122 and the diametrical surface 123 of the driveshaft 64. The pump cavity 124 is defined axially between a first annular ledge 126 (i.e., a ledge defining a transition between the pump cavity surface 122 and the bearing surface 120) and a porting plate 128 that is mounted to the second bearing 54 at or near the second axial end 118. The pump cavity surface 122 may be concentric with the diametrical surface 123 of the driveshaft 64. In some configurations, the pump cavity surface 122 could be eccentric relative the diametrical surface 123.

Figure 5:
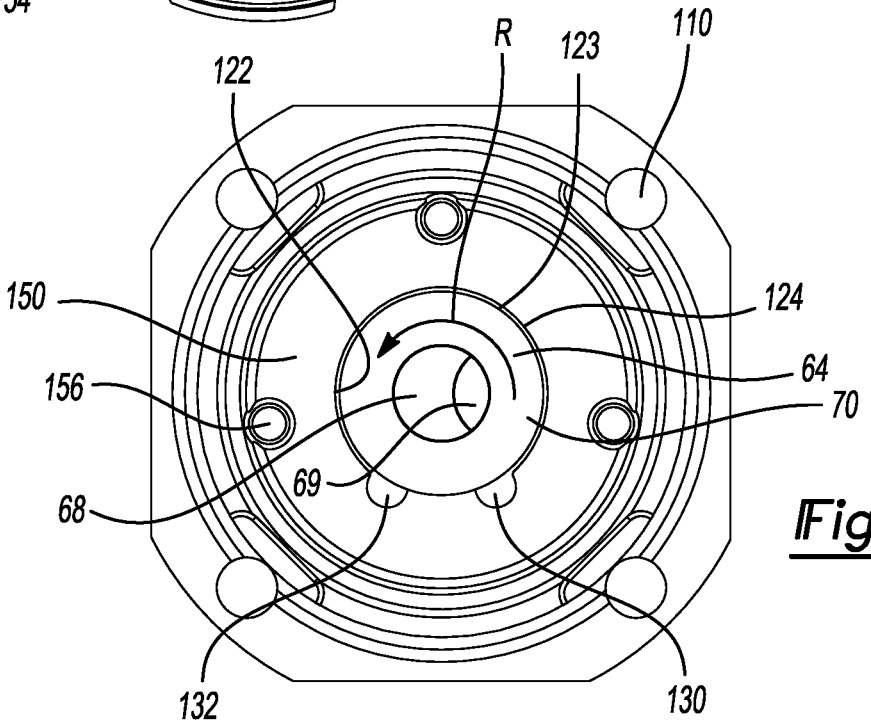
FIG. 5 is a bottom view of the oil pump with the porting plate and cover plate removed.
Figure 6:
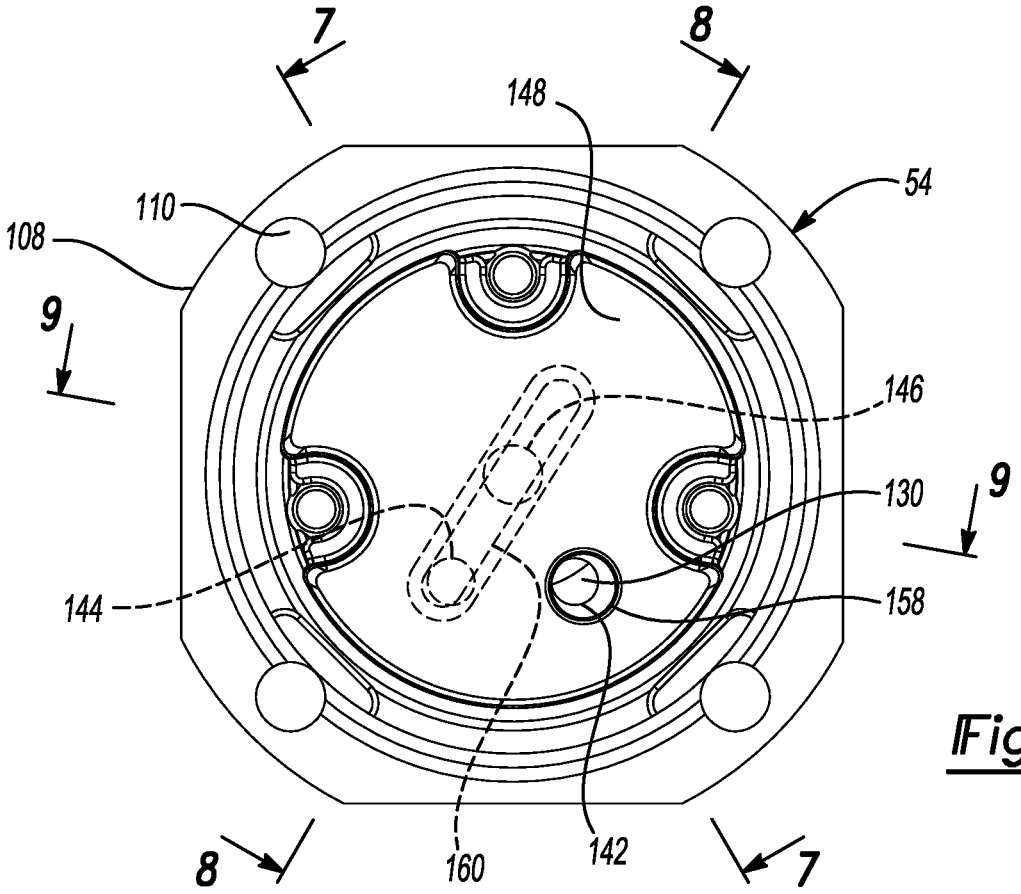
FIG. 6 is a bottom view of the oil pump with the porting plate and cover plate in place.

The pump cavity 124 extends partially around the diametrical surface 123 of the driveshaft 64. For example, the pump cavity 124 may extend more than 180 degrees around the diametrical surface 123. In some configurations, the pump cavity 124 may roughly 270 degrees around the diametrical surface 123. The pump cavity 124 includes an inlet passage 130 (FIGS. 5 and 7) and an outlet passage 132 (FIGS. 5 and 8). As will be described in more detail below, oil enters the pump cavity 124 through the inlet passage 130 and exits the pump cavity 124 through the outlet passage 132. The inlet passage 130 and outlet passage 132 may define first and second angular ends (i.e., first and second ends in a rotational direction) of the pump cavity 124.

Figure 7:
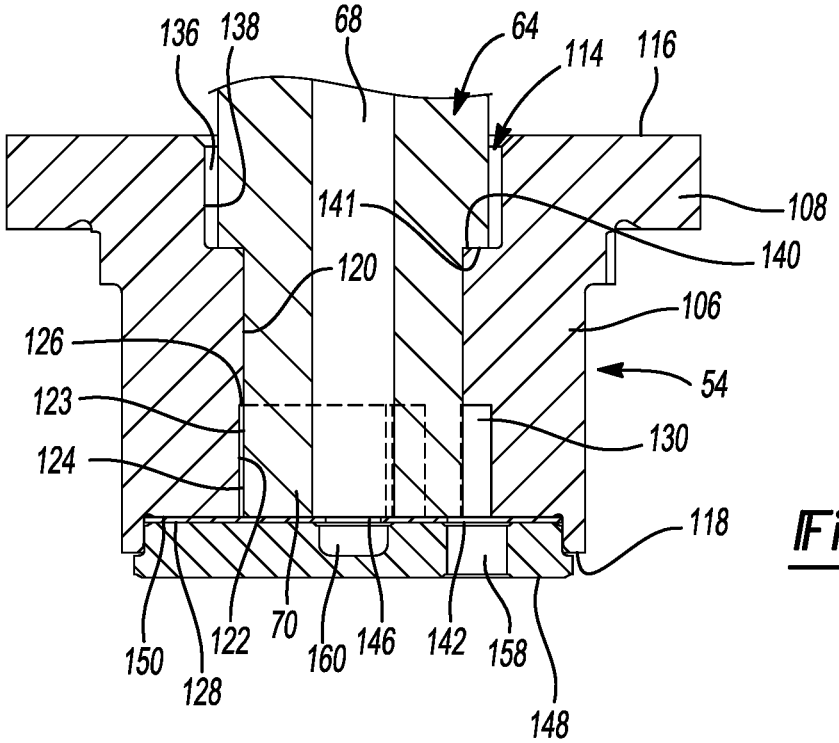
FIG. 7 is a cross-sectional view of the oil pump taken along line 7-7 of FIG. 6.
Figure 9:
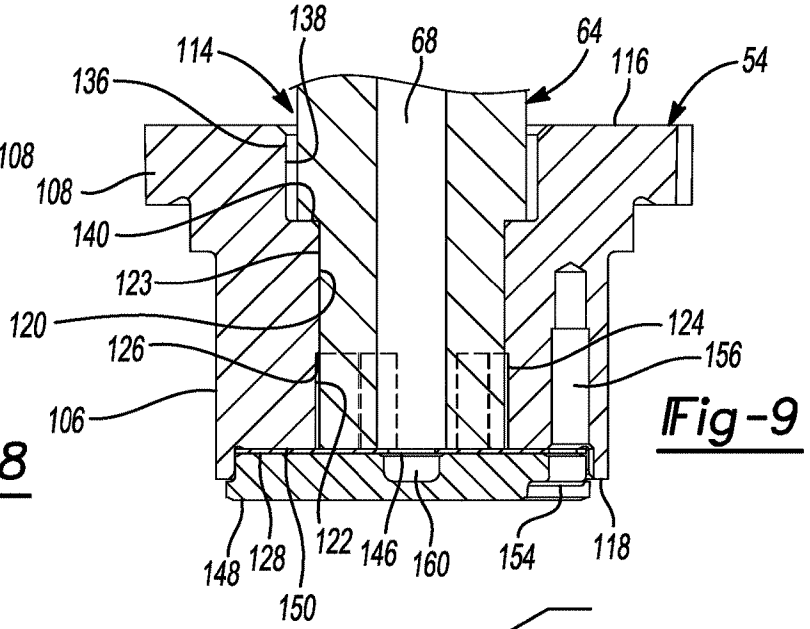
FIG. 9 is a cross-sectional view of the oil pump taken along line 9-9 of FIG. 6.
Figure 8:
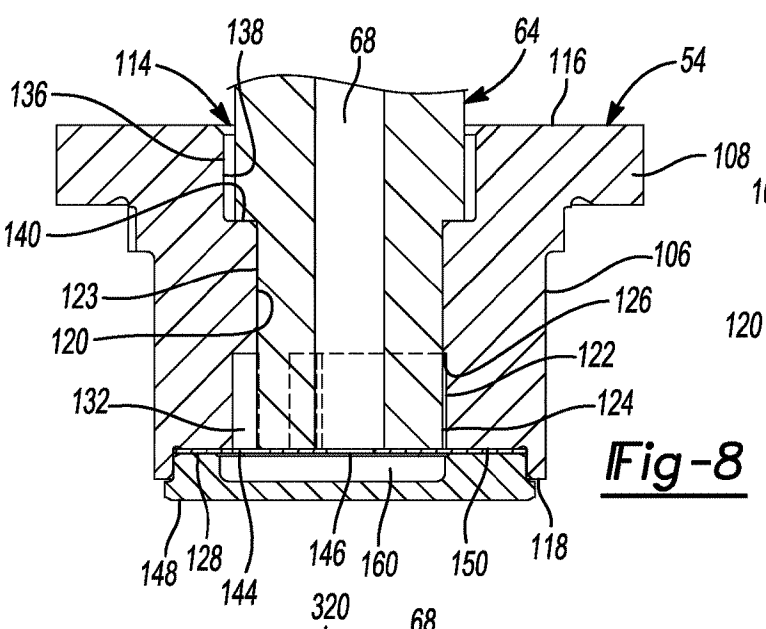
FIG. 8 is a cross-sectional view of the oil pump taken along line 8-8 of FIG. 6.

As shown in FIGS. 7-9, the central aperture 114 of the second bearing 54 may also include an upper recess 136 at or near the first axial end 116 of the second bearing 54. The upper recess 136 may be defined by a diametrical surface 138 of the second bearing 54 that has a larger diameter than the bearing surface 120. A second annular ledge 140 may define a transition between the diametrical surface 138 and the bearing surface 120. The second annular ledge 140 may axially support the driveshaft 64. That is, the second annular ledge 140 of the second bearing 54 may contact an annular, axially facing surface 141 of the driveshaft 64.

The porting plate 128 includes an inlet aperture 142 (FIGS. 2, 4 and 7), an outlet aperture 144 (FIGS. 2, 4, and 8), and a driveshaft inlet aperture 146 (FIGS. 2, 4, and 7-9). The porting plate 128 may be mounted to the second bearing 54 at or near the second axial end 118. The porting plate 128 may partially cover the central aperture 114 of the second bearing 54. The inlet aperture 142 of the porting plate 128 is generally aligned with (or concentric with) and in fluid communication with the inlet passage 130 of the second bearing 54. The outlet aperture 144 of the porting plate 128 is generally aligned with (or concentric with) and in fluid communication with the outlet passage 132 of the second bearing 54. The driveshaft inlet aperture 146 may be generally aligned with (or concentric with) and in fluid communication with the concentric lubricant passage 68 of the driveshaft 64. The pump cavity 124 is disposed axially between the porting plate 128 and the annular ledge 126 and radially between the diametrical surface 123 of the pump cavity surface 122.

A cover plate 148 may be mounted to the second bearing 54 at or near the second axial end 118. The porting plate 128 may be sandwiched between the cover plate 148 and an axially facing surface 150 of the second bearing 54 (i.e., at or near the second axial end 118). Fasteners 152 (FIG. 2) may extend through mounting apertures 154 in the cover plate 148 and engage mounting apertures 156 in the second bearing 54 to fixedly mount the cover plate 148 and the porting plate 128 to the second bearing 54.

The cover plate 148 may include an inlet aperture 158 and a channel 160. As shown in FIG. 7, the inlet aperture 158 is generally aligned with and in fluid communication with the inlet aperture 142 of the porting plate 128 and the inlet passage 130 of the second bearing 54. A shown in FIG. 8, the channel 160 is in fluid communication with the outlet passage 132 of the second bearing 54, the outlet aperture 144 of the porting plate 128, the driveshaft inlet aperture 146 of the porting plate 128, and the concentric lubricant passage 68 of the driveshaft 64. That is, oil exits the pump cavity 124 through the outlet passage 132 and outlet aperture 144, then flows from the outlet aperture 144 to the channel 160, and then flows from the channel 160 through the driveshaft inlet aperture 146 and into the concentric lubricant passage 68 in the driveshaft 64.

During operation of the compressor 10, the motor assembly 18 drives rotation of the driveshaft 64 in a direction R (counterclockwise when viewed from the frame of reference of FIG. 5) about a rotational axis A (FIG. 1) defined by the first and second bearings 50, 54. Such rotational motion of the driveshaft 64 relative to the second bearing 54 causes oil from the oil sump 39 to be drawn in through the inlet apertures 158, 142 of the cover plate 148 and porting plate 128, respectively, and into the inlet passage 130. From the inlet passage 130, the oil flows through the pump cavity 124 (i.e., around the diametrical surface 123 of the driveshaft 64 in the direction R) toward the outlet passage 132. Shear forces due to rotation of the driveshaft 64 relative to the stationary second bearing 54 drives the oil in the pump cavity 124 in the rotational direction R (i.e., the same direction in which the driveshaft 64 rotates) from the inlet passage 130 toward the outlet passage 132.

Oil exits the pump cavity 124 through the outlet passage 132. From the outlet passage 132, the oil flows through the outlet aperture 144 of the porting plate 128, through the channel 160 in the cover plate 148, through the driveshaft inlet aperture 146 in the porting plate 128, and into the concentric lubricant passage 68 in the driveshaft 64. The oil flows from the concentric lubricant passage 68 to the eccentric lubricant passage 69. The oil flows through the eccentric lubricant passage 69 and may exit the driveshaft 64 at the distal axial end 71 of the crank pin 66. In some configurations, the driveshaft 64 may include oil outlet apertures that extend radially outward from the eccentric lubricant passage 69.

The flow rate of oil into the driveshaft 64 is dependent on the rotational speed of the driveshaft 64. Therefore, the oil pump of the present disclosure is well-suited to provide adequate amounts of oil at any speed at which the compressor 10 is operating at any given time. That is, in configurations in which the compressor 10 is a variable-speed or multiple-speed compressor, the oil pump is able to pump appropriate amounts of oil at any and all speeds at which the compressor is operable. The oil pump of the present disclosure pumps oil in a manner that is energy efficient. Furthermore, the oil pump of the present disclosure is relatively simple and relatively inexpensive to manufacture.

Figure 11:
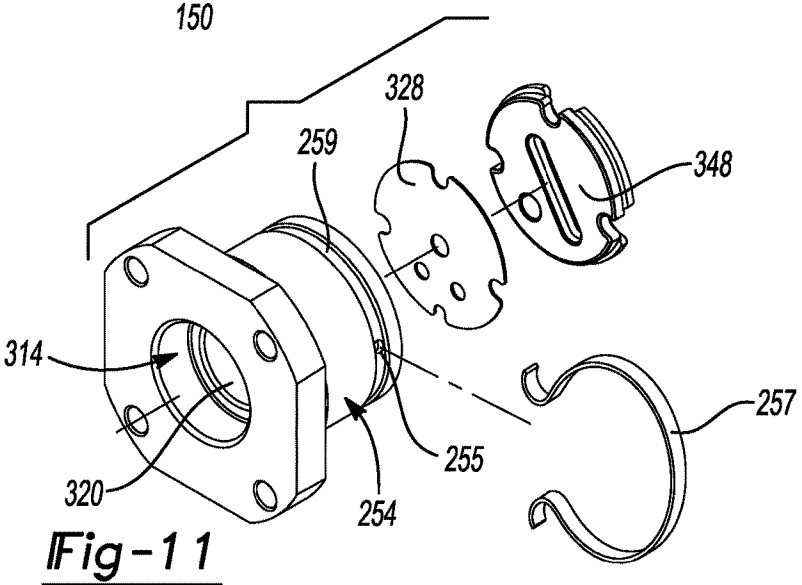
FIG. 11 is an exploded view of a bearing, porting plate, cover plate, and pressure-regulation valve shown in FIG. 10.
Figure 10:
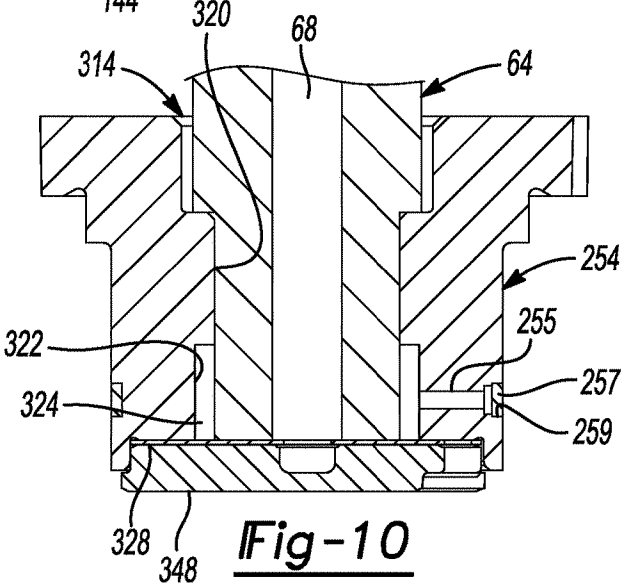
FIG. 10 is a cross-sectional view of another oil pump according to the principles of the present disclosure.

Referring now to FIGS. 10 and 11, another second bearing 254 is provided that can be incorporated into the compressor 10 instead of the second bearing 54. The second bearing 254 may be similar or identical to the second bearing 54 described above, except the second bearing 254 includes a pressure-regulation port 255 and a pressure-regulation valve 257. Like the second bearing 54, the second bearing 254 may cooperate with the driveshaft 64 to define an oil pump.

Like the second bearing 54, the second bearing 254 may include a central aperture 314 (like the central aperture 114) that includes a bearing surface 320 (like the bearing surface 120) and a pump cavity surface 322 (like the pump cavity surface 122). The driveshaft 64 may be received in the central aperture 314. The bearing surface 320 rotatably supports the driveshaft 64. The outer diametrical surface 123 of the driveshaft 64 cooperates with the pump cavity surface 122 to define a pump cavity 324 (like pump cavity 124). Like the second bearing 54, the second bearing 254 includes an inlet passage and an outlet passage (like inlet passage 130 and outlet passage 132) in fluid communication with the pump cavity 324. A porting plate 328 (similar or identical to the porting plate 128) and cover plate 348 (similar or identical to the cover plate 148) are mounted to the second bearing 254 in a similar or identical manner as described above with respect to the second bearing 54, porting plate 128, and cover plate 148.

The pressure-regulation port 255 of the second bearing 254 may be in fluid communication with the pump cavity 324. The pressure-regulation port 255 may extend radially outward from the pump cavity 324 and may extend through an exterior surface of the second bearing 254.

The pressure-regulation valve 257 may be or include a movable member that selectively plugs the pressure-regulation port 255. For example, the pressure-regulation valve 257 may be a spring or another resiliently flexible member that selectively prevents fluid communication between the pressure-regulation port 255 and the oil sump 39 (or the suction chamber 42). In the example shown in FIGS. 10 and 11, the pressure-regulation valve 257 is an omega-shaped ring or clip that is received within an annular slot or groove 259.

Operation of the oil pump defined by the second bearing 254 may be similar or identical to the oil pump defined by the second bearing 54, except the pressure-regulation port 255 and pressure-regulation valve 257 can selectively relieve pressure within the pump cavity 324. That is, when the oil pressure within the pump cavity 324 reaches a predetermined level, the oil pressure moves (e.g., flexes) the pressure-regulation valve 257 to allow fluid communication between the pressure-regulation port 255 and the oil sump 39 (or suction chamber 42). That is, when the pressure-regulation valve 257 opens the pressure-regulation port 255, oil is allowed to leak from the pump cavity 324 back to the oil sump 39 until the pressure in the pump cavity 324 is reduced below the predetermined level. Once the pressure in the pump cavity 324 is reduced below the predetermined level, the pressure-regulation valve 257 moves back to the closed position to prevent leakage from the pump cavity 324 to the oil sump 39.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly;

a compression mechanism disposed within the shell assembly and configured to compress a working fluid;

a driveshaft drivingly connected to the compression mechanism and including a lubricant passage; and a bearing fixed relative to the shell assembly and including a central aperture that receives a portion of the driveshaft, wherein:

the central aperture of the bearing includes a bearing surface and a pump cavity surface, the bearing surface contacts and rotatably supports the driveshaft, the pump cavity surface is spaced apart from the driveshaft and cooperates with a diametrical surface of the driveshaft to define a pump cavity that extends around the diametrical surface of the driveshaft, the bearing includes an inlet passage and an outlet passage, the inlet passage receives oil from an oil sump and provides oil to the pump cavity, the outlet passage receives oil from the pump cavity and provides oil to the lubricant passage of the driveshaft, and a shear force due to rotation of the driveshaft relative to the bearing drives oil in the pump cavity in a rotational direction from the inlet passage toward the outlet passage, and wherein the rotational direction is the same rotational direction in which the driveshaft rotates.

2. The compressor of claim 1, wherein the pump cavity surface has a larger diameter than the bearing surface.

3. The compressor of claim 2, wherein the bearing includes an annular ledge that defines a transition between the pump cavity surface and the bearing surface, and wherein the annular ledge defines an axial end of the pump cavity.

4. The compressor of claim 1, further comprising a porting plate mounted to the bearing and including an inlet aperture, an outlet aperture, and a driveshaft inlet aperture, wherein the porting plate defines an axial end of the pump cavity.

5. The compressor of claim 4, wherein:

the inlet aperture of the porting plate is in fluid communication with the inlet passage of the bearing and provides oil to the inlet passage, the outlet aperture of the porting plate is in fluid communication with the outlet passage of the bearing and receives oil from the outlet passage, the driveshaft inlet aperture is in fluid communication with the lubricant passage of the driveshaft, and the driveshaft inlet aperture receives oil from the outlet aperture and provides oil to the lubricant passage of the driveshaft.

6. The compressor of claim 5, wherein an axial end of the driveshaft contacts the porting plate.

7. The compressor of claim 5, further comprising a cover plate mounted to the bearing, wherein the porting plate is sandwiched between the cover plate and an axially facing surface of the bearing.

8. The compressor of claim 7, wherein:

the cover plate includes an inlet aperture and a channel, the inlet aperture of the cover plate receives oil from the oil sump and provides oil to the inlet aperture of the porting plate, and the channel receives oil from the outlet aperture of the porting plate and provides oil to the driveshaft inlet aperture of the porting plate.

9. The compressor of claim 1, further comprising a pressure-regulation valve attached to the bearing, wherein the bearing includes a pressure-regulation port that extends from the pump cavity through an exterior surface of the bearing, and wherein the pressure-regulation valve selectively restricts fluid flow through the pressure-regulation port.

10. The compressor of claim 1, wherein the pump cavity extends more than 180 degrees and less than 360 degrees around the driveshaft.

11. The compressor of claim 1, wherein the shell assembly defines the oil sump.

12. The compressor of claim 1, wherein the lubricant passage of the driveshaft is a concentric lubricant passage, and wherein the driveshaft includes an eccentric lubricant passage in fluid communication with the concentric lubricant passage.

13. A compressor comprising:

a compression mechanism configured to compress a working fluid; and an oil pump defined by a driveshaft and a bearing, wherein:

the driveshaft is drivingly connected to the compression mechanism and includes a lubricant passage, the bearing receives a portion of the driveshaft and includes a bearing surface that rotatably supports the driveshaft, the bearing includes a pump cavity surface that is spaced apart from the driveshaft and cooperates with a diametrical surface of the driveshaft to define a pump cavity that extends around the diametrical surface of the driveshaft, the bearing includes an inlet passage and an outlet passage, the inlet passage receives oil from an oil sump and provides oil to the pump cavity, the outlet passage receives oil from the pump cavity and provides oil to the lubricant passage of the driveshaft, and the pump cavity extends more than 180 degrees and less than 360 degrees around the driveshaft.

14. The compressor of claim 13, wherein the pump cavity surface has a larger diameter than the bearing surface, wherein the bearing includes an annular ledge that defines a transition between the pump cavity surface and the bearing surface, and wherein the annular ledge defines an axial end of the pump cavity.

15. The compressor of claim 13, further comprising a porting plate mounted to the bearing and including an inlet aperture, an outlet aperture, and a driveshaft inlet aperture, wherein the porting plate defines an axial end of the pump cavity.

16. The compressor of claim 15, wherein:

the inlet aperture of the porting plate is in fluid communication with the inlet passage of the bearing and provides oil to the inlet passage, the outlet aperture of the porting plate is in fluid communication with the outlet passage of the bearing and receives oil from the outlet passage, the driveshaft inlet aperture is in fluid communication with the lubricant passage of the driveshaft, and the driveshaft inlet aperture receives oil from the outlet aperture and provides oil to the lubricant passage of the driveshaft.

17. The compressor of claim 16, wherein an axial end of the driveshaft contacts the porting plate.

18. The compressor of claim 16, further comprising a cover plate mounted to the bearing, wherein the porting plate is sandwiched between the cover plate and an axially facing surface of the bearing.

19. The compressor of claim 18, wherein:

the cover plate includes an inlet aperture and a channel, the inlet aperture of the cover plate receives oil from the oil sump and provides oil to the inlet aperture of the porting plate, and the channel receives oil from the outlet aperture of the porting plate and provides oil to the driveshaft inlet aperture of the porting plate.

20. The compressor of claim 13, further comprising a pressure-regulation valve attached to the bearing, wherein the bearing includes a pressure-regulation port that extends from the pump cavity through an exterior surface of the bearing, and wherein the pressure-regulation valve selectively restricts fluid flow through the pressure-regulation port.

21. The compressor of claim 13, wherein the lubricant passage of the driveshaft is a concentric lubricant passage, and wherein the driveshaft includes an eccentric lubricant passage in fluid communication with the concentric lubricant passage.

* * * * *